United States Patent [19]

Vanjo

[11] 4,043,484

[45] Aug. 23, 1977

[54] NEWSPAPER VENDING MACHINE

[76] Inventor: Benno Vanjo, Wehrweg 13
Klagenfurt, Kaernten, Austria

[21] Appl. No.: 636,421

[22] Filed: Dec. 1, 1975

[30] Foreign Application Priority Data

Dec. 3, 1974 Austria ..... 9671/74

[51] Int. Cl.[2] ..... G07F 11/16; B65H 1/14

[52] U.S. Cl. ..... 221/213; 221/232; 221/227; 221/225; 271/18.3; 271/24; 271/141; 221/245

[58] Field of Search ..... 221/39, 210, 213, 225, 221/226, 227, 232, 259, 279, 280, 245; 271/18.3, 22, 24, 129, 141, 149

[56] References Cited

U.S. PATENT DOCUMENTS

| | | | |
|---|---|---|---|
| 416,340 | 12/1889 | Moodic | 221/259 X |
| 1,530,209 | 3/1925 | Scheuner | 271/129 |
| 1,659,167 | 2/1928 | Schultz | 221/227 X |
| 2,858,047 | 10/1958 | Williams et al. | 221/213 |
| 3,180,518 | 4/1965 | Roser | 221/232 X |
| 3,888,479 | 6/1975 | Eder et al. | 271/22 |

*Primary Examiner*—Robert B. Reeves
*Assistant Examiner*—Joseph J. Rolla
*Attorney, Agent, or Firm*—Blanchard, Flynn, Thiel, Boutell & Tanis

[57] ABSTRACT

A newspaper vending machine has a receptacle with a front wall, a rearwardly ascending slide track to support a stack of newspapers on edge, the lower end of the slide track having an upstanding ledge to hold back the foremost paper in the stack which is pressed forward by a presser plate whose upper part is parallel to the front wall and whose lower part inclines rearwardly, and a delivery mechanism which by means of inclined needles engaging the foremost paper in the stack lifts the said paper until its lower edge swings forward over the upstanding ledge and then feeds the paper downwards through a delivery slot between the upstanding ledge and the front wall.

5 Claims, 3 Drawing Figures

NEWSPAPER VENDING MACHINE

Figure 1:
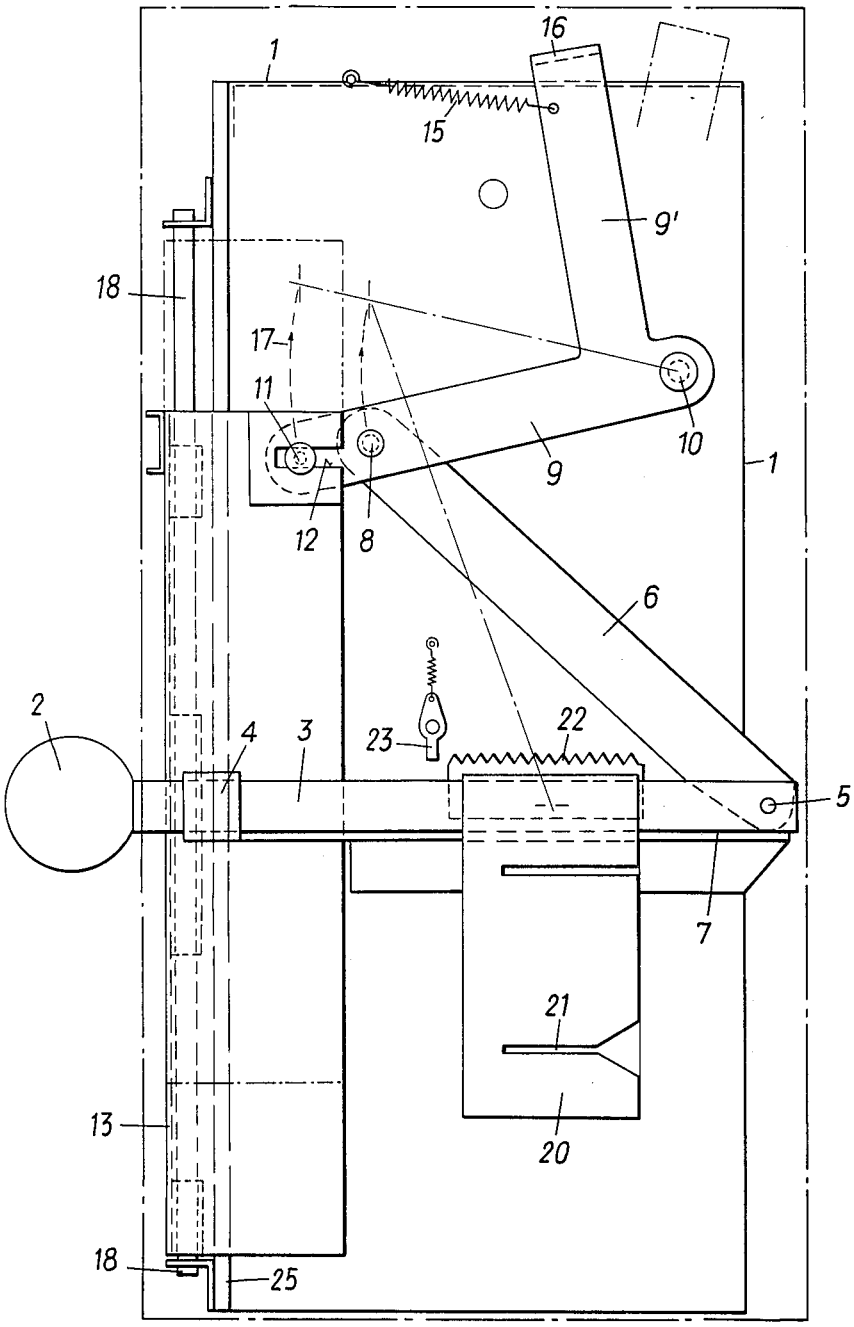

The invention concerns an automatic vending machine for newspapers or the like, having a receptacle for a stack of newspapers or the like, which receptacle has a delivery slot provided in the lower part, as well as a delivery device which, after the insertion of a coin and by the operation of a handle, takes a newspaper from the stack and delivers it to a delivery slot, the newspapers of the stack standing upright one behind the other, rest on a rearwardly ascending slide track, on the front forward edge of which there is provided an upwardly projecting ledge, furthermore the delivery slot is arranged between the lower edge of a wall, limiting forwardly the reception space of the housing, and the upwardly projecting ledge, furthermore a member is provided for exerting a forward pressure, which member presses the stack standing on the slide track at the top slightly against the front wall and at the bottom against the ledge, and finally the delivery device at least at two places, has carriers which, on actuation by means of the handle, engage the foremost newspaper or the like of the stack and lift it up so far that the lower edge of the newspaper comes to rest above the upper edge of the ledge.

Instead of newspapers similar articles, such as journals, brochures, catalogues and the like, as well as carrier bags for goods, may be delivered the automatic machine and these are referred to in the attached claims simply as "paper".

The automatic newspaper vending machines known hitherto, for example as disclosed by U.S. Pat. No. 2,713,441, have various shortcomings which have impeded their use on a large scale. The disadvantage often resides in the fact that the automatic machine functions correctly only for newspapers of a certain thickness, whereby for example it is not possible to vend also a much thicker weekly edition without converting the mechanism.

A further disadvantage consists in the fact that owing to the given construction, the newspapers are pressed so strongly against the aforesaid ledge that there is difficulty in lifting them over this ledge.

Furthermore, it is a disadvantage that the foremost newspaper is lifted by means of a carrier and carried by its lower edge over the delivery slot, in which after withdrawal of the carrier it has to drop by its own weight. This newspaper, however, is under the action of a plate pressing the stack forwardly, whereby friction is set up and may prevent the foremost newspaper from dropping out, so that it is not delivered.

The invention is accordingly based on the problem of providing an automatic vending machine for newspapers and the like which no longer has the disadvantages of the known construction. Starting from an automatic vending machine of the type hereinbefore mentioned, this is achieved according to the invention in that the upper part of the pressure member of flat construction is parallel to the vertical front wall of the housing, and the lower end part of the pressure member extends backwardly and downwardly at an acute angle to a vertical plane, such that on raising the foremost newspaper, its lower part swings by the force of gravity into the vertical position and comes to rest above the delivery slot, and a further carrier device is provided which becomes operative after completion of the lifting movement of the foremost newspaper and moves the latter downward into the delivery slot. The downward pulling following the lifting of the newspaper being delivered overcomes the friction otherwise interferingly opposing release, thus ensuring the dropping of the newspaper into delivery slot.

For the upwardly or downwardly acting carrier devices, obliquely upwardly or obliquely downwardly directed needles or other members terminating in points or sharp edges are preferably used, which are held by needle carriers movably mounted on a part movable in a vertical direction by the actuating device, which needle carriers are acted upon by springs which press the needles against the foremost newspaper of the stack. The carriers of the needles or the like preferably project through longitudinal slots of the front wall of the housing into the interior space of the latter, so as to be able to engage the stack of newspapers.

Figure 2:
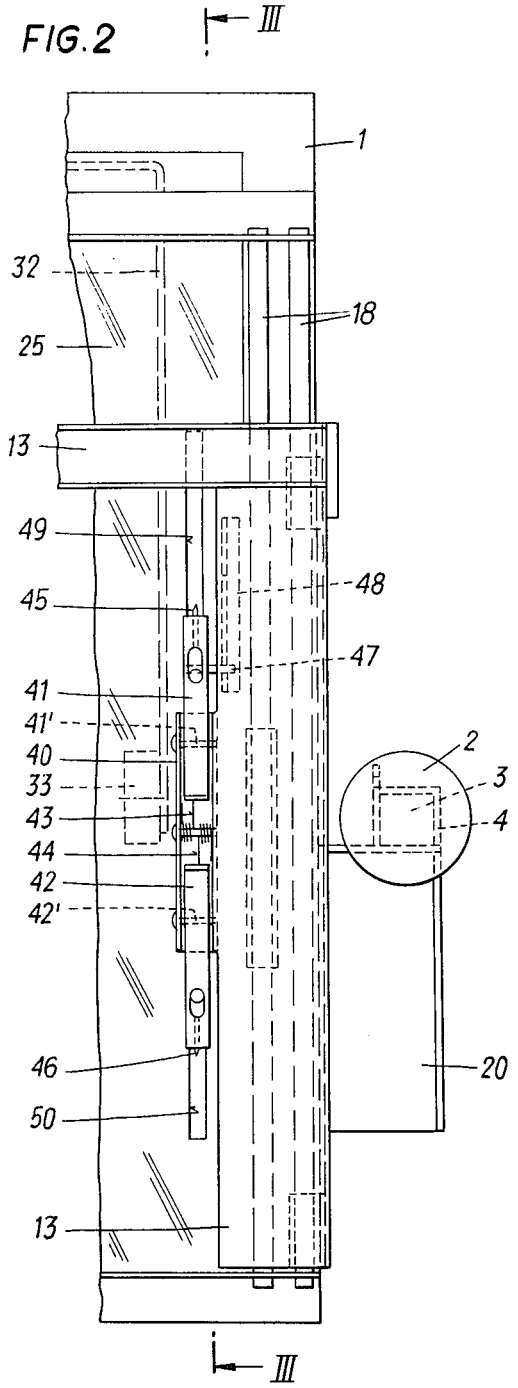
Figure 3:
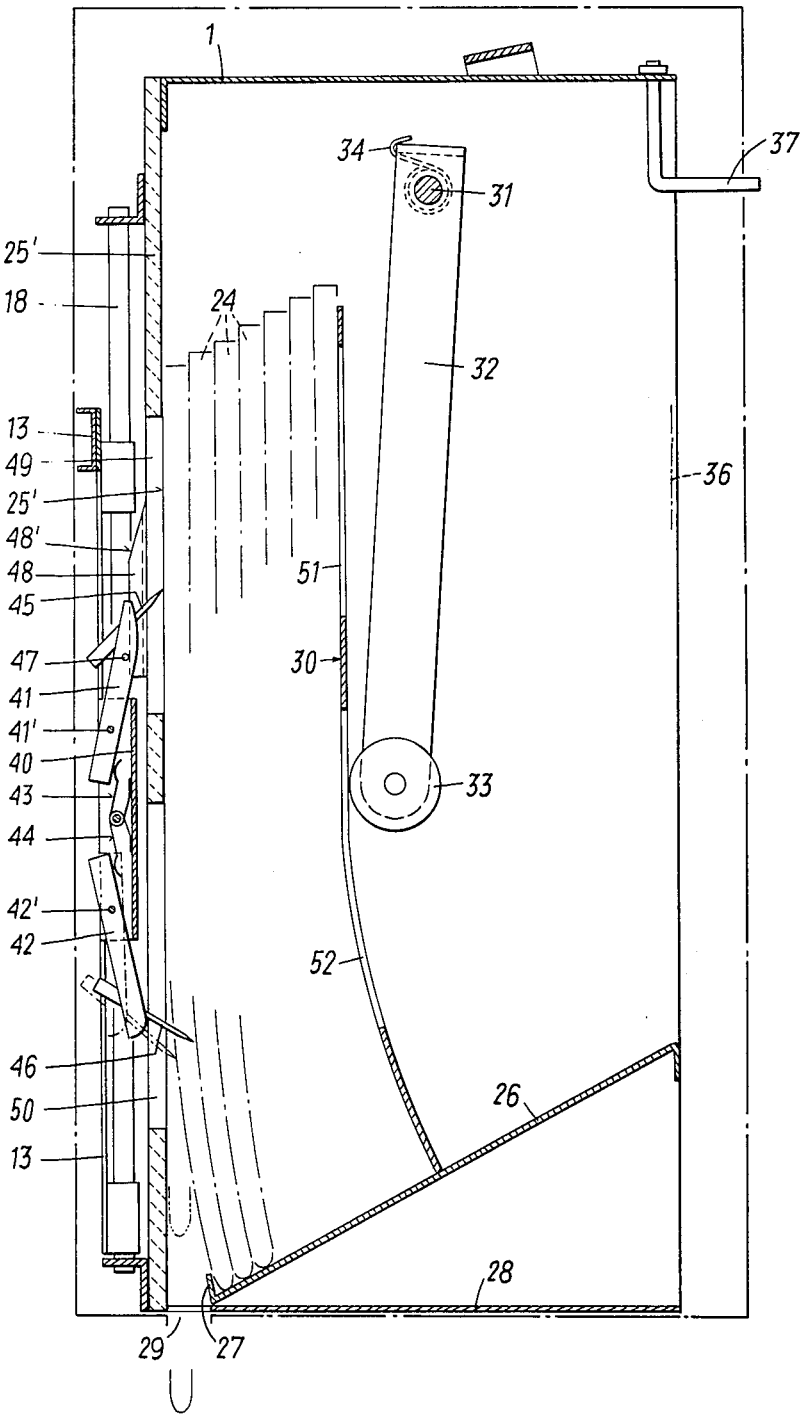

The subject of the invention is described more particularly in the following with reference to an embodiment example represented in the accompanying drawings, in which:

FIG. 1 shows a side view of an automatic vending machine according to the invention with an actuating device, FIG. 2 is a part front view of the automatic machine, and FIG. 3 is a section on line III—III of FIG. 2 with side view of the control device for the carriers.

The automatic vending machine comprises a box-shaped housing 1, provided with an operating device mounted laterally externally thereof and formed of a handle 2, engaging an operating rod 3, which in the horizontal position is slidingly mounted on the outside of the housing 1 in a sleeve 4. The end opposite the handle 2 carries a hinge pin 5 engaged by a control link 6. The control link 6 projects obliquely upward and slides by its lower end on a guide surface 7, while its upper end in hingedly connected by a pin 8 to a bell-crank lever 9, 9'.

The bell-crank lever 9, 9' is mounted near its apex on a pin 10 fast with the housing. The free end of the arm 9 of the bell-crank lever 9, 9' is slidably mounted by means of a pin 11 in a longitudinal slot 12 of a U-shaped frame 13. The second 9' of the bell-crank lever 9, 9' is under the action of a tension spring 15. This arm 9' forms one arm of a U-shaped yoke 16 leading to a second bell-crank lever, mounted symmetrically on the other side of the housing 1, as shown in FIG. 1.

The frame 13, which is thus coupled on both sides to a bell-crank lever, is moved upward or downward by withdrawing or pushing in the rod 3. If, in fact, the rod 3 is withdrawn by the handle 2, the lower end of the control link 6 slides forwardly along the horizontal quide surface 7 and presses the bell-crank lever 9, 9' upwardly and hence also the bell-crank lever arranged symmetrically on the opposite side of the housing 1, whereby the two bell-crank levers are swung upwardly in an arc along the path 17 and lift the U-shaped frame by means of the pin 11. For guiding the frame 13, guide rods 18 are mounted on both sides of the housing 1.

Withdrawal of the operating rod 3 is possible only under certain conditions, because a device 20 known per se, not shown more particularly but indicated diagrammatically and mounted on the side wall of the housing 1 permits the withdrawal of the operating rod 3 only when a suitable number of coins have been inserted in the slot 21. The device 20 thus represents a lock against unauthorised withdrawal of the operating rod 3.

There is further provided on the top of the operating rod 3 a toothed rack 22, extending in the longitudinal direction of the operating rod 3 and co-operating with a locking tooth 23 under spring action, the said tooth engaging the rack 22 on retraction of the operating rod 3 and preventing premature sliding back of the operating rod 3, but allowing it only when the locking tooth 23 has already run along the entire rack 22. This device thus serves to oblige the user of the automatic machine to withdraw the operating rod 3 completely in order then to push it in again and thus permit the delivery of a newspaper.

It will be seen from FIG. 3 that the housing 1 has a large inner space accommodating a stack of newspapers 24. On the front side, the space is closed off by a preferably transparent plate 25 extending over the entire area and made for example of glass or Plexiglass. The stack of newspapers 24 stands on an obliquely ascending slide track 26 inclined at an angle to the horizontal of approximately 30° and provided on its left-hand front end with a ledge 27 about 2 cm in height. The bottom 28 of the housing 1 does not extend as far as the front but ends where the ledge 27 is situated. Between the ledge 27 and the front plate 25 is a delivery slot 29 for the newspapers.

For pressing the stack of newspapers forward, there is provided a pressure plate 30, the upper part of which is parallel to the plate 25, while in the lower third part it is slightly curved and rests with its lower end approximately at a right angle on the slide track 26. For exerting a forward pressure on the plate 30, there is mounted in the upper part of the side walls of the housing 1 on horizontal pins 31 a U-shaped yoke 32, which carries on the end of each of its arms a pressure roller 33, and these rollers 33 are pressed against the pressure plate 30 by the action of torsion springs 34.

To enable a stack of newspaper 24 to be laid in the space destined for them, the back wall 36 of the housing 1 can be opened like a door and the pressure-applying device 32 to 34 can be swung upwardly about the axes 31 against the action of the spring 34, and it can also be held fast in the uppermost position by two pivotal catches 37 arranged symmetrically on both sides of the housing and whose horizontal arms can be swung under the yoke arms 32. Thereupon, the pressure plate 30 can be taken out and a stack of newspapers can be placed in, so that the foremost newspaper lies at the top against the plate 25. The pressure plate 30 is then laid against the last newspaper of the pile and the pressing device 32 to 34 is released again by swinging out the catches 37 so that it takes up the position shown and presses the pile of newspapers 24 to the left by means of plate 30.

In order always to be able to effect delivery of the first newspaper of the pile of newspapers, the following further device is provided:

Projecting rearwardly from the U-shaped frame 13 on the front side of the housing 1 close to its two side walls are carriers 40, on which are pivotally mounted by means of respective pivots 41' and 42' two needle carriers 41 and 42. The needle carriers 41 and 42 are pressed by springs 43 and 44, respectively, at their upper or lower end against the plate 25 and at this respective end each carries a needle 45 or 46, of which the needle 45 is directed obliquely upward and the needle 46 obliquely downward, the spring 43 having a stronger pressing force than the spring 44. On the upper needle carriers 41 there is also mounted a transversely projecting pin 47 slidingly guided along guide surfaces 48 provided on the housing 1. The points of the needles 45, which are mounted on both sides in the same manner, do not project beyond the back 25' of plate 25 but are located within the cross-section of the said plate which is provided with suitable openings 49 in the path of movement of the needles 45. Opposite each of the lower carriers the plate 25 is also provided with an opening 50 in which the needles 46 can move.

If by pulling the handle 2 to the left, the frame 13 on which the carriers 41 and 42 are mounted is lifted, the carriers 41 and 42 are also moved upwardly, the lower needles 46 sliding along the foremost newspaper of the stack of newspapers.

The upper needles 45 move upwardly in the initial vertical part of the guide 48, within the space of the slot 49 of the plate 25 and do not yet contact the foremost newspaper. As soon, however, as the transverse pin 47 arrives on the upper part 48' of the guide 48, which is inclined to the plate 25, the springs 43 rock the carrier 41 in the clockwise direction, whereby the needles 45 are applied to the foremost newspaper or are forced into the latter somewhat by the force of the springs. The carrier 41 and the needles 45 thus transmit the lifting movement of the frame to the foremost newspaper, which is thereby also lifted. This lifting is effected through a height which is somewhat greater than the height of the projecting ledge 27 of the slide track 26, whereby the foremost newspaper is lifted over the projecting ledge 27 and its fold swings out against the plate 25. The foremost newspaper is thereby located above the delivery slot 29. Since the newspaper is no longer held by the ledge 27 and if the friction between the plate 25 and the upper parts of the stack of newspapers is not too great, the newspaper can drop down. Generally, however, this newspaper will have to be pulled down because the friction is too great.

To effect this pulling down, the needles 46 are furthermore provided on both sides of the side walls of the plate 25. During the upward movement of the frame 13, these needles 46 are also moved upward, sliding with their downwardly directed points, which are able to yield resiliently, over the foremost newspaper, without penetrating it. As soon, however, as the upward movement of the frame 13 is terminated and by pushing in the handle 2, the downward movement of frame 13 and needles 46 commences, the points of the needles 46 under the action of springs 44 penetrate the surface of the foremost newspaper and push it downwardly.

The foremost newspaper thereby passes with its lower edge through slot 29 and can thus be grasped by the purchaser and pulled down, the needles 46 yielding resiliently. To permit this action, as previously mentioned, the springs 44 of the lower needle carriers 42 are made much weaker than the springs 43 of the upper needle carriers 41.

On pushing the operating rod 3 into its end position, the starting position is reached again, and after insertion of coins, a further newspaper may be removed.

The press-on plate 30 is formed with the slots 49,50 corresponding to slots 51,52 in plate 25, which slots the needle points can enter when all the newspapers have been sold, thereby preventing damage to the needles.

I claim:

1. An automatic vending machine for papers having a receptacle for a stack of papers, said receptacle having a frontwall and a delivery slot, a delivery device arranged to remove a paper from the stack and feed it to the delivery slot, an operating handle for said delivery device, a rearwardly ascending slide track having an upstanding ledge at its forward edge, said delivery slot being defined between said front wall and said upstanding ledge, a pressure member for exerting forward pressure on a stack of papers placed on edge on the said slide track, said pressure member having an upper part whose pressure surface is parallel to the said front wall and a lower part whose pressure surface extends rearwardly and downwardly at an acute angle to said surface of said upper part, whereby the upper part of the foremost paper of the stack is pressed against the front wall while the lower part is pressed against the said upstanding ledge, said delivery device having first carriers engageable with the said foremost paper of the stack to lift said foremost paper until its lower edge rises above the upstanding ledge and swings forward above the delivery slot, said first carriers comprising obliquely-upwardly-directed pointed members mounted on a carriage movable in a vertical direction by said operating handle, said pointed members being biassed toward said foremost paper by springs, and second carriers engageable with the said foremost paper to feed it downwards into the delivery slot, said second carriers comprising obliquely-downwardly-directed pointed members mounted on said carriage and biassed toward said foremost paper by springs.

2. A machine as claimed in claim 1, wherein the pointed members extend through slots in the said front wall to engage the papers.

3. A machine as claimed in claim 2, wherein the pressure member is a plate having slots corresponding in position to the slots in the front wall whereby the needles can enter the slots in the pressure plate in the absence of a stack of papers.

4. A machine as claimed in claim 1 including a yoke mounted in the receptacle for swinging movement about a horizontal axis, a pressure roller mounted on the yoke, spring means biassing said yoke to a position in which the pressure roller presses against the pressure member, and latch means for holding said yoke in a lifted position for the insertion of a stack of papers.

5. A machine as claimed in claim 1 including an operating rod mounted for horizontal to and fro movement, said operating handle being attached to said operating rod, a coin-release locking mechanism for said rod, a pair of levers mounted on opposite sides of the receptacle for movement about a common horizontal axis, a yoke rigidly connecting said levers, a link pivotally connected to one of said levers and to said operating rod, said levers being coupled to said carriage to lift and lower said carriage upon reciprocation of said operating rod.

* * * * *